US005592892A

United States Patent [19]

Kerckhoff

[11] Patent Number: 5,592,892

[45] Date of Patent: Jan. 14, 1997

[54] MULTIHULL WINDSURFER

[76] Inventor: Brian Kerckhoff, 2110 Farms Rd., Tallahassee, Fla. 32311

[21] Appl. No.: 543,058

[22] Filed: Oct. 13, 1995

[51] Int. Cl.[6] ..... B63B 35/00

[52] U.S. Cl. ..... 114/39.2; 114/163

[58] Field of Search ..... 114/39.1, 39.2, 114/61, 123, 144 R, 153, 91, 93, 163, 162

[56] References Cited

U.S. PATENT DOCUMENTS

| | | | |
|---|---|---|---|
| 4,100,870 | 7/1978 | Prade | 114/39.2 |
| 4,349,340 | 9/1982 | Hoffmann | 114/162 |
| 4,524,709 | 6/1985 | McKenna | 114/61 |
| 4,715,306 | 12/1987 | Horais | 114/39.2 |
| 4,771,723 | 9/1988 | Friesen | 114/162 |
| 4,930,433 | 6/1990 | Tirez | 114/39.2 |
| 5,024,177 | 6/1991 | Winter et al. | 114/39.2 |
| 5,038,694 | 8/1991 | Yamada et al. | 114/61 |
| 5,042,411 | 8/1991 | Krolczyk | 114/61 |

*Primary Examiner*—Stephen Avila
*Attorney, Agent, or Firm*—Enrique G. Estevez, Atty.

[57] ABSTRACT

A multihull windsurfer providing increased sailing stability, exceptional steerability and providing a moveable mast allowing for an adjustable sail carrying capacity. The preferred embodiment is a catamaran with hulls that are elongated, upwardly curved and substantially triangular in transverse cross-section, thereby forming keels. Dual rudders, disposed in tandem, are mounted under each hull and are controlled through a steering assembly. One rudder in each pair is removable so that the steering sensitivity of the boat may be varied. The mast is fully articulating and is disposed with a sail and a manually engageable boom. The mast is carried on a mast mount comprising a mast track assembly which is slidably adjustable fore and aft, so that the mast may be moved forward or rearward on the vessel, thereby providing for an adjustable sail area. The hulls are attached to and held substantially parallel by a platform providing deck space for the sailor. The steering assembly may be connected to the platform by resilient means that automatically return the assembly to a center position after a turn, thereby bringing the rudders to an amidships position.

2 Claims, 6 Drawing Sheets

MULTIHULL WINDSURFER

FIELD OF INVENTION

The present invention relates generally to sailing vessels, sailboats or windsurfers and more specifically to a multihull windsurfer, such as a catamaran or trimaran, of small size, with a fully articulating, fore and aft adjustably moveable mast and hand controlled boom and sail assembly, such as used in common sailing surfboards, and designed to be controlled and steered from a standing position by a sailor using a foot-operable rudder control mechanism.

DESCRIPTION OF PRIOR ART

Sailboards or windsurfers have become increasingly popular in recent years. Apparently, the sport began when a surfboard was coupled with a mast and sail combination, perhaps some twenty five years ago.

While sailboard designs have continued to proliferate, other hull configurations have not been fully explored as potentially adaptable to a fully articulating mast and sail assembly. Sailboarding, undisputedly a fun sport, requires a high degree of expertise for mastery. The sailor must develop the requisite skill at balancing the sailboard. This requires not only proper balance, but also agility and strength. In an effort to overcome some of the difficulties in learning to handle the conventional sailboard, other equipment configurations have been developed.

Two sailboards have previously been joined into a twin-hulled sailing vessel with an articulating mast. U.S. Pat. No. 5,024,177, issued on Jun. 18, 1991, to Winter et al., teaches a wind sailing surf vessel with dual planar surfaces. Due to its two hulls and wider stance, this craft offers some increased stability over the conventional sailboard, thus allowing someone with less developed balancing skills to handle the vessel. The Winter vessel is fitted with a centerboard, which is said to provide substantial steerability. The vessel may, additionally, be fitted with rear fins on the sailboards, for added directional stabilization.

The Winter patent, while providing several advantages, does not offer the increased course tracking ability conferred by hulls that are substantially triangular in cross-section, nor does it provide the advantage of full directional control through the foot-operable rudder mechanism described in the present invention. Furthermore, while Winter provides for some steerability, the use of a fixed centerboard requires that the boat be steered through use of the sail and the sailor's balance, which is quite difficult in a multihull boat configuration. In contrast, the present invention provides for fully rotating dual rudders in tandem arrangement for exceptionally responsive steering and quick turning of the craft.

In addition, the Winter boat's design is such that coming about and jibing cannot be attempted in the usual fashion for a sailboard. When coming about on a sailboard, the sailor turns the craft's bow through the wind and, as the force of the wind carries the sail around the stern of the boat, the sailor walks around in front of the mast and grabs the boom on the new windward side to guide the boat on its new tack. The Winter boat's design does not provide deck space in front of the mast, thereby making it very difficult for the sailor to walk around the front of the mast to perform the maneuver described above. Furthermore, when jibing a sailboard, that is, turning the boat with the wind coming over the stern, the sailor flips the sail forward around the front of the craft, grabbing the sail on the opposite side after it has come around full circle. The sailor is then free to set a new tack.

U.S. Pat. No. 4,771,723 was issued to Friesen for a sailboard assembly having a foot-operable steering assembly. This patent teaches a single hulled, flat-bottomed sailboard including a centerboard, a foot-operable rudder and a mast and sail assembly of limited angular displacement. In this configuration, the mast is supported in a standing position once it is released by the sailor, thus the mast is not fully articulating. The Friesen patent does not teach the increased stability derived from a multihull craft, nor the improved course tracking obtained through use of hulls of triangular cross-section, eliminating the need for a cumbersome centerboard, nor does Friesen teach the quick response to course changes brought about by the combined application of a fully articulating mast with dual foot-operable tandem rudders, all of which are taught by the invention disclosed herein. In addition, because Friesen's boat has a mast of limited forward and backward tilt, the boat's center of lateral resistance is also limited to the available arc of tilt of the mast. In the present invention, however, the center of lateral resistance of the boat is entirely adjustable due to the much larger swing arc of the fully articulating mast, thereby granting the sailor maximum control. Finally, because the mast in the Friesen boat is not fully articulating, it cannot lie flat on the boat's deck. If the sailor loses his balance and falls off, the boat will flip over in the water; this cannot happen in the present design.

U.S. Pat. No. 4,530,299 was issued to Ross on Jul. 23, 1985, for a collapsible wind surfing vessel. The invention by Ross is a wind propelled surfboard with a catamaran hull, wherein the hulls, mast and boom can be folded or collapsed for transport, and storage. In addition, while this catamaran incorporates hulls that are essentially triangular in cross-section, for improved tracking in the water, the hulls are not upwardly curved as in the present design. The upwardly curved hulls presented herein further reduce the need for center boards while providing course tracking that is improved over a straight hull design. Furthermore, the design of the Ross boat indicates that the center of balance of the windsurfer is not properly located and the boat would benefit from placement of a rear fin on each hull to move the center of balance aft along the hull. Without a centerboard, fins or rudders, the Ross boat will be very difficult to steer and maneuver. The primary object of the Ross windsurfer appears to be directed at stowability rather than at increased sailing efficiency. While the Ross invention provides the advantages of stability, some improvement in course tracking, an articulating mast and stowability for transport or storage, it does not teach a foot-operable steering mechanism for full control of the craft by the sailor, the use of dual rudders in tandem arrangement for increasing the craft's course tracking and turning agility, nor the curved hull design of this invention.

A multihull sailing vessel, such as a catamaran, is well known to be difficult to turn. This resistance to turning is due in part to the hulls each tending to turn such that the hull inner to the turn completes a smaller arc than the hull outer to the turn. The hull on the outside of the turn tends to travel a longer distance than the hull on the inside of the turn. This disparity in travel distance between the hulls creates resistance and hinders the craft's turning ability. Neither of the multihulls in the Winter, nor Ross patents teaches a mechanism to overcome difficult turning. The present invention, which incorporates dual, foot-operable, rudders arranged in tandem, offers superior turning agility for this multihull vessel. The larger surface area presented by dual rudders on each hull greatly increases the turning quickness of the boat and provides an advantage not previously available.

Other related but less relevant prior art may be found in the following U.S. Pat. No. 5,120,249 for a combination catamaran boat and cross water ski system; 5,042,411 for a collapsible catamaran sailboat; 4,936,242 for an inflatable catamaran kit; 4,907,521 for a line lock; 4,850,916 for a sailboard steering arrangement; 4,715,306 for a catamaran with a steerable centerboard apparatus and an improved deck joint; 4,480,572 for a tiller tender; 4,027,614 for sailboat construction; 3,985,090 for a sport boat; 3,742,886 for a catamaran; and 2,251,133 for a flanking rudder.

OBJECTS AND ADVANTAGES

Accordingly, several objects and advantages of the present invention are:

a) to provide a multihull windsurfing craft of increased stability and ease of use by the unskilled sailor;

b) to provide a multihull windsurfing craft of increased stability, ease of use and of exceptional steerability and turning agility;

c) to provide a multihull windsurfing craft with a fore and aft moveably adjustable mast, such that sail size may be changed according to wind and weather conditions or the personal preference of the sailor;

d) to provide a multihull windsurfing craft which allows the sailor to control its course through a foot-operable steering assembly which automatically returns the craft to a straight course after a turn.

DRAWING FIGURES

Figure 1:
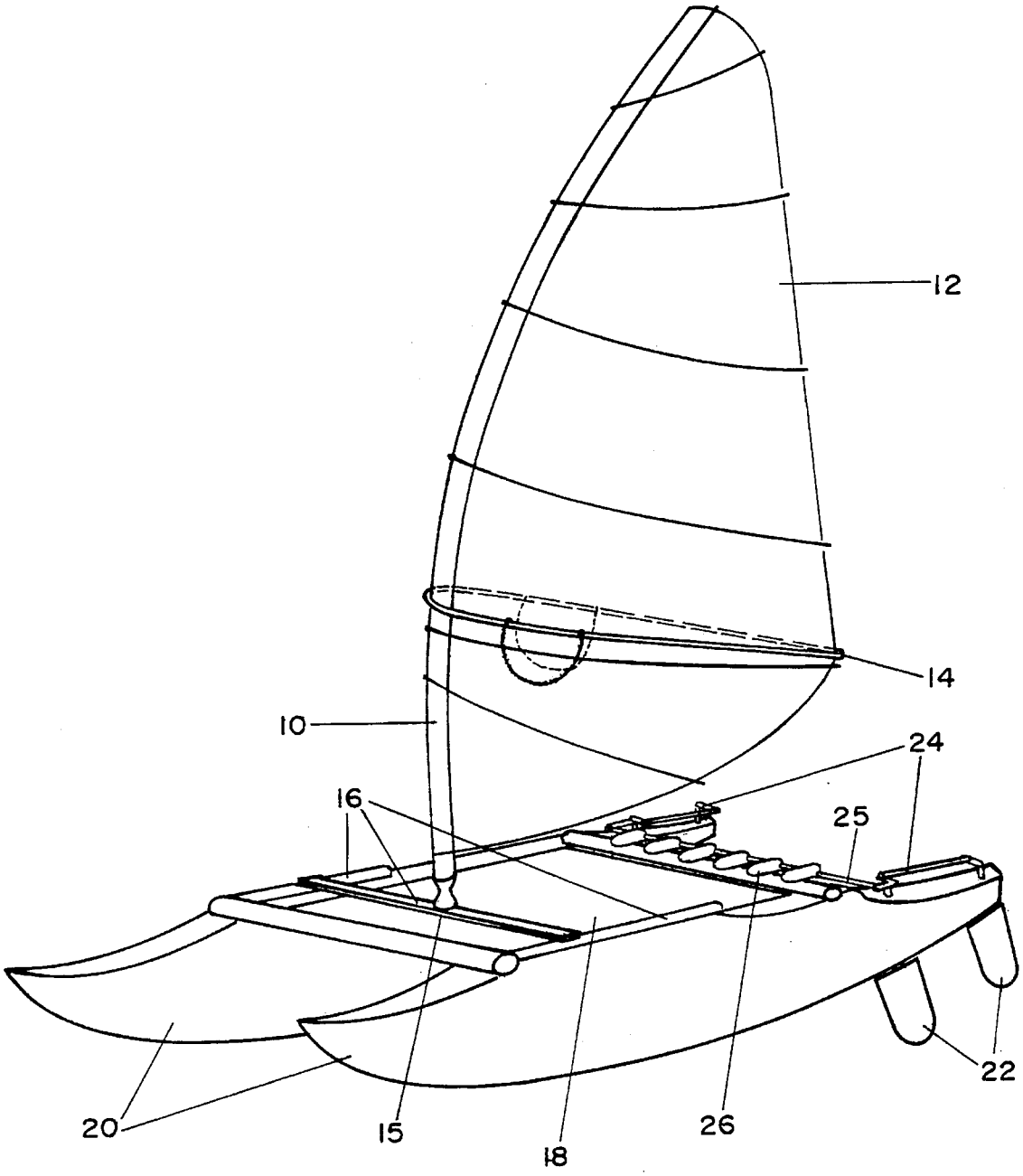
FIG. 1 is a front top left perspective view of the multihull windsurfer of the present invention.
Figure 2:
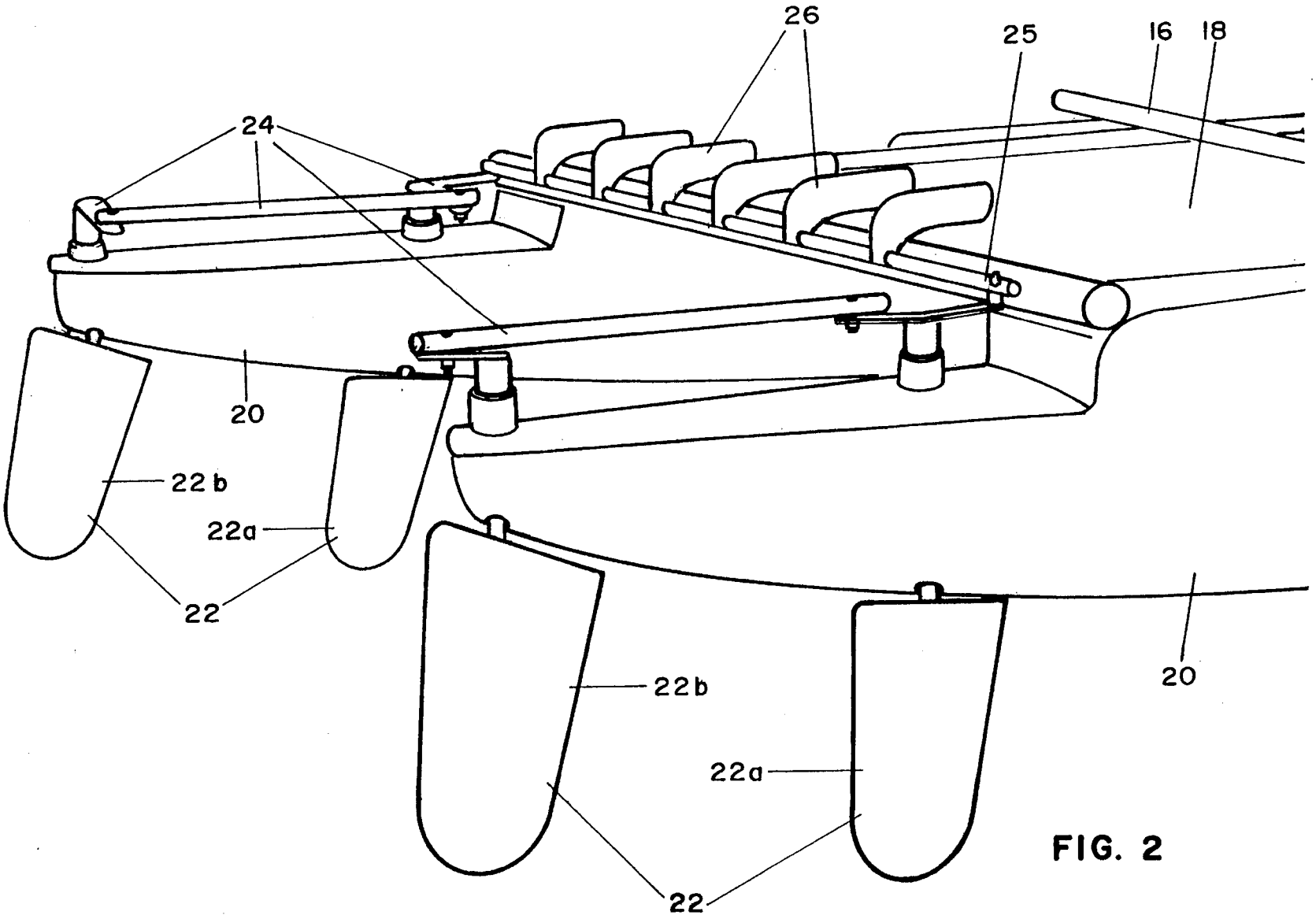
FIG. 2 is a rear top right perspective partial view of the boat, showing the after end of the hulls and platform means, including the rudders and steering assembly.
Figure 3:
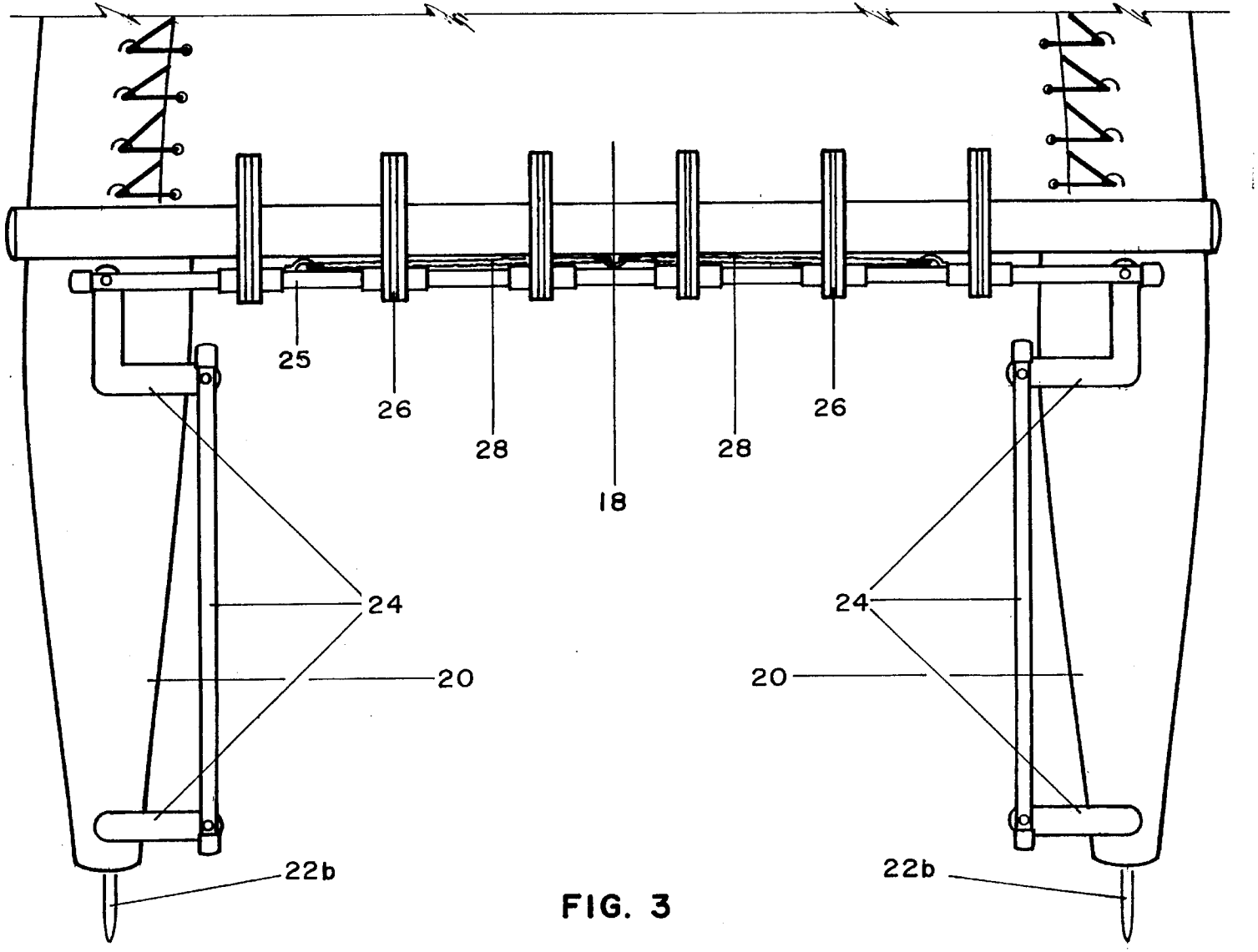
FIG. 3 is a partial top view of the after end of the boat, showing the relationship of the steering assembly and rudders to the hulls and to the platform means.
Figure 4:
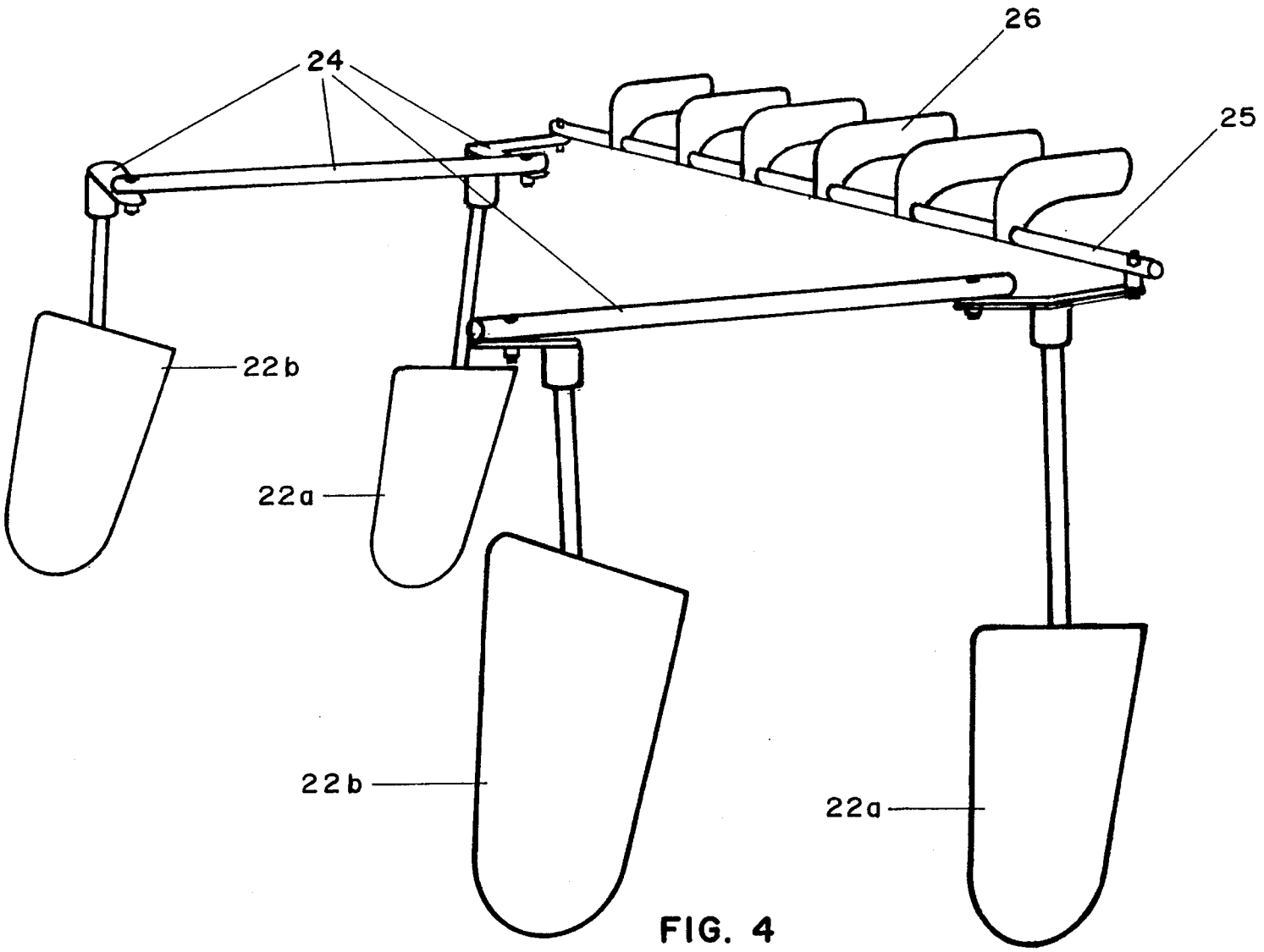
FIG. 4 is a rear top right perspective view of the steering assembly and rudders isolated from the hulls.
Figure 5:
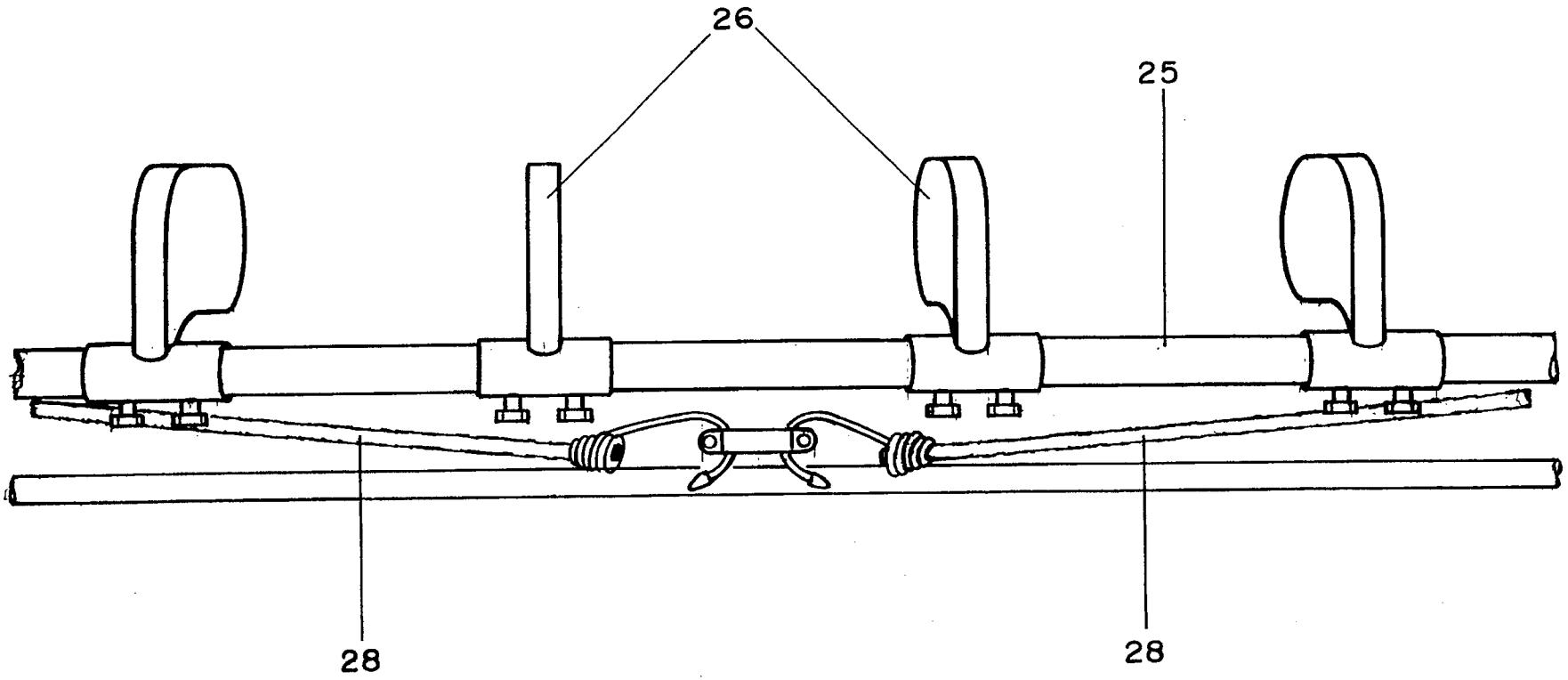
FIG. 5 is a bottom view of the foot-operable tiller means, slidably mounted onto the steering lever and held in place by set screws; the tiller means is shown self-centering by means of elastic cord.
Figure 6:
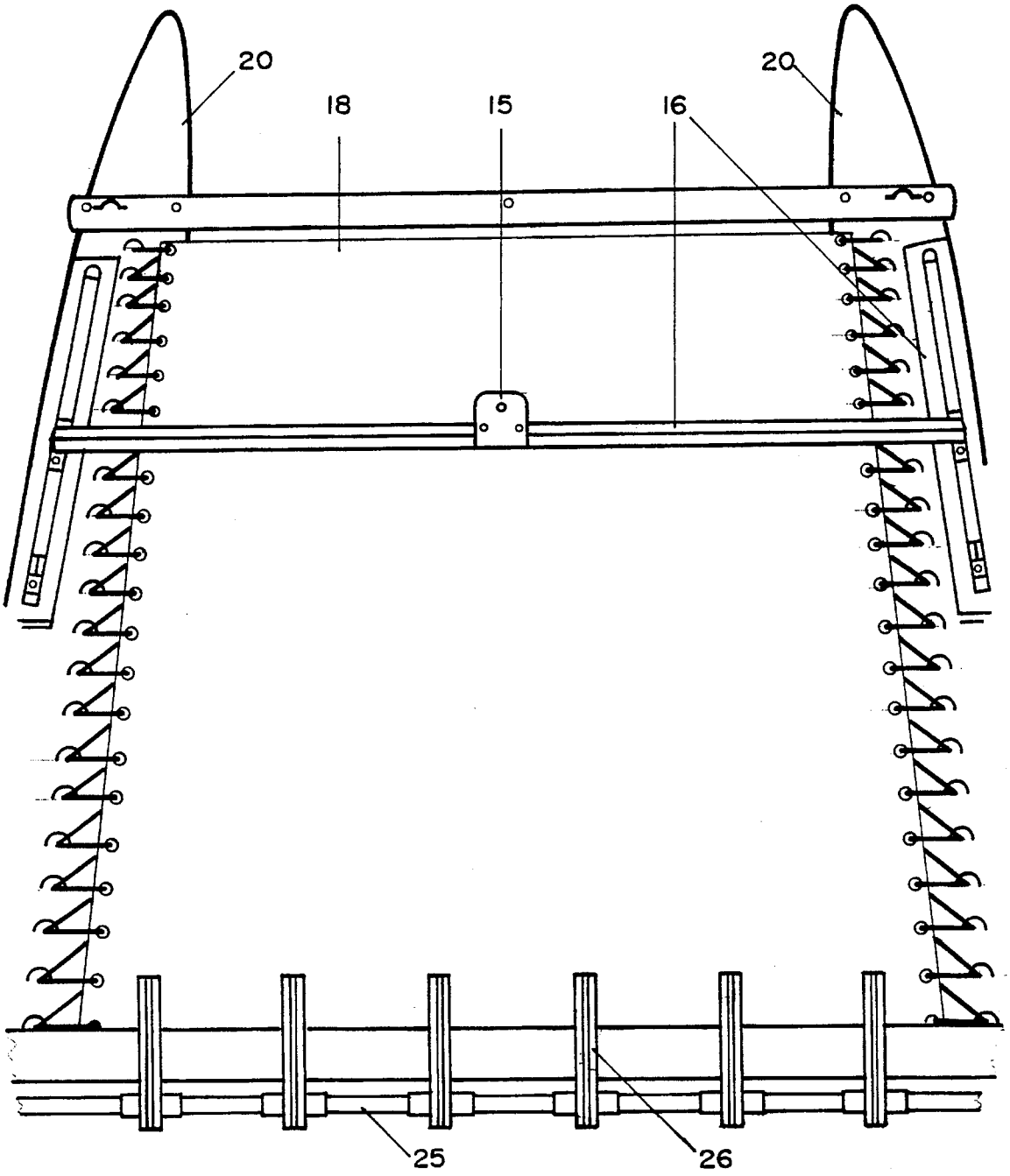
FIG. 6 is a top rear perspective view of the platform means, showing the fore and aft moveable mast track assembly as well as attachment points for the harness means.

| List of Reference Numerals | |
|---|---|
| 10 | mast |
| 11 | pivot point |
| 12 | sail |
| 14 | boom |
| 15 | mast mount |
| 16 | track assembly |
| 18 | platform |
| 20 | hull |
| 22 | rudders |
| 22a | forward rudder, of fore rudder |
| 22b | after rudder, or aft rudder |

-continued

| List of Reference Numerals | |
|---|---|
| 24 | steering assembly |
| 25 | tiller linkage rod |
| 26 | foot-operable tiller paddles |
| 28 | steering centering means |

DESCRIPTION

FIGS. 1 through 6

The multihull windsurfer claimed herein is preferably embodied as a single-masted, twin-hulled vessel, or catamaran, as shown in FIGS. 1 through 6. Alternate embodiments encompass a catamaran with more than one mast, and a tri-hulled vessel, or trimaran, with one or more masts.

As shown in FIG. 1, the catamaran includes a fully articulating mast 10 carrying a sail 12 and a manually engageable boom 14. The mast 10 is carried on a fore and aft moveable track. assembly 16 which is mounted on the vessel. The moveable track assembly 16 allows the sailor to change the position of the mast 10 fore and aft relative to the craft. Providing for such adjustment allows the sailor to increase or decrease the available sail-carrying area and, thus, to change sail size depending on wind and weather conditions or personal preference, A platform 18 provides standing space for the sailor and joins the hulls 20, thereby holding them substantially parallel to each other.

The hulls 20 are elongated, upwardly curved and substantially triangular in transverse cross-section, formed of a rigid material such as glass fiber cloth and are packed with a buoyant filler, rendering the boat unsinkable. The hulls' 20 substantially triangular transverse cross-section provides the form of a keel as the hulls 20 lie in the water and allows the catamaran to sail and track a true course without the need for a centerboard.

Each hull 20 is disposed with twin rudders **22*a–b* at its aft end. Each pair of rudders 22*a–b* is arranged in tandem, that is, one in front of the other. The forward rudder 22*a* in each pair is removably mounted so that the sailor may choose the degree of steering response desired of the craft, allowing for adjustment due to weather conditions or personal preference. Twin rudders 22*a–b* on each hull 20 provide the greatest steering sensitivity and turning quickness due to the increased rudder surface exposed to the water. By removing the forward rudder 22*a* on each hull 20 the vessel remains easily steerable, through the aft rudder 22*b* remaining on each hull 20**, however, the response is more gradual and gentle.

The rudders **22*a–b* are linked and controlled through a steering assembly 24, which terminates in a tiller linkage rod 25 upon which a plurality of short, foot-operable tiller paddles 26, are slidably mounted. The tiller paddles 26 allow the standing sailor to use foot pressure to engage the tiller linkage rod, transmitting force to the rudders 22*a–b* via the steering assembly 24, thereby altering the vessel's course. The steering assembly 24 may be automatically returned to a centered position, such that the rudders 22*a–b* are amidships, by appropriately placed elastic shock cord or equivalent resilient steering centering means 28 connecting the steering assembly 24** to a stationary part of the vessel. By activating the foot-operable steering mechanism the vessel's course may be altered slightly or the vessel may be completely turned through the wind, either by tacking or jibing.

Additional steerability, as in a conventional windsurfer, is available by tilting the mast 10 forward or aft on the its pivot point 11 on the mast mount 15, thereby effecting minor course changes. Slight course modifications may also be made by the sailor balancing his weight against the angle of the sail 12 while pushing on the vessel with his feet. These maneuvers are well known with conventional windsurfers in use today but do not provide the enhanced control available through the foot-operable dual tandem rudders 22*a–b*.

The preferred embodiment has been thus described only for purposes of illustrating the principles of the present invention. Those skilled in the art can readily devise alternate embodiments, modifications or equivalents. Since many changes and modifications are possible, the exact construction and operation shown and described herein are not to be considered as limiting the scope of the claimed invention.

Operation

The multihull windsurfer claimed herein is operated in substantially the same manner as conventional windsurfers available today. The craft is controlled from a standing position by a lone sailor or, in an alternate embodiment with dual masts, by two sailors operating as a team.

While the same well known principles of wind powered sailing craft apply to the present invention, the multihull windsurfer herein provides various operational advantages.

The standing sailor manually controls the boom 14 to properly align the sail 12 relative to the direction of the wind, thereby causing the wind to propel the craft through the water. Because the sail 12 is carried on a fully articulating mast 10, such as in a conventional windsurfer, the sailor may move the sail 12 fore and aft by changing the inclination of the mast 10. By so doing, the sailor may bring about minor course changes as the point where the sail 12 offers resistance to the wind is altered fore and aft relative to the vessel. This level of control is also available in prior art conventional windsurfers.

In addition, the sailor may change the course of the present. craft through the foot-operable steering assembly 24 provided. The sailor pushes with one foot on short tiller paddles 26 mounted on the tiller linkage rod 25. The tiller linkage rod 25 activates the steering assembly 24, which turns the tandem dual rudders 22*a–b*, thereby changing the craft's course. Dual rudders 22*a–b* provide a large surface exposed to the flow of water and afford a very sensitive steering response. When the sailor turns the craft through the wind, either by tacking or jibing, the sailor handles the turn as in a conventional windsurfer.

The mast 10 is attached to the pivot point 11 on a mast mount 15 which comprises an adjustable track assembly 16 allowing the mast to be moved forward or rearward relative to the vessel. The sailor, therefore, can move the mast 10 forward on the vessel when desiring to carry a larger sail 12, or rearward when wishing to reduce the sail-area triangle for carriage of a smaller sail 12. This provides the sailor with a unique adjustment that allows tuning the speed and balance of the craft according to weather conditions, to the sailor's preference or to the sailor's level of ability. By employing a larger sail 12, the sailor can expect the boat to increase in speed, yet be less stable due to the larger sail area exposed to the wind. By employing a smaller sail 12 , the sailor can reduce the speed of the vessel and increase its stability, an ideal way for a beginner to learn boat handling.

To further dampen the boat's maneuvering sensitivity, the sailor may remove the detachably mounted fore rudder 22*a* on each hull 20. This reduces the rudder surface area exposed to the flow of water and results in slower turning speed. Through this change, the sailor can further tune down the agility of the craft. By providing the appropriate combination of rudder 22*a–b* configuration and sail 12 size, the boat's responsiveness can be finely tuned to account for weather conditions or the sailor's proficiency. As the sailor gains in confidence and technique, the boat's responsiveness may be increased, in effect, allowing the boat to grow with the sailor's experience.

SUMMARY, RAMIFICATIONS AND SCOPE

Accordingly, the reader will appreciate that this multihull windsurfer, intended to be operable by a standing sailor, provides a versatile sailing craft which provides a number of advantages over common windsurfers previously used. The multihull design provides increased stability, while the triangular cross section of the hulls results in a craft that does not require a centerboard to maintain a true course without undue leeway. The present craft provides for a mast that is moveable fore and aft, thereby allowing the sailor to increase or decrease the available sail area. The mast is also fully articulating, so that it may be tilted by the sailor to further control the craft, as in a conventional windsurfer. Furthermore, the present craft incorporates a foot-operable steering system, allowing the standing sailor to exercise superior control over the craft's direction. For additional advantage, the steering system employs dual rudders mounted in tandem on each hull, thereby providing increased rudder surface to afford a very sensitive turning response.

Although the description herein incorporates specific details, these are for illustration purposes only and should not be construed as limiting the scope of the invention. For example, the vessel could be manufactured in varying dimensions and with two or more masts for use by a team of sailors, analogously to other sports performed either by individuals or in teams, such as bobsledding or bicycling.

Thus, the attached claims and their legal equivalents should determine the scope of the invention, rather than the illustrative examples provided.

What is claimed is:

1. A wind powered sailing vessel operable by a standing sailor, comprising:

a plurality of hulls, said hulls being elongated, upwardly curved and substantially triangular in transverse cross-section, each said hull thereby forming a keel; platform means for providing deck space, whereby said hulls are joined and held substantially parallel to each other;

mast mount means, comprising a fore and slidably adjustable mast track assembly attached to said vessel, for carrying a mast;

mast means for carrying sail means and boom means, said mast means being pivotally mounted onto said mast track assembly, thereby being fully articulating and fore and aft translocatable on said vessel;

sail means, releasably attached to said mast mesas, for providing wind power;

boom means for directionally controlling said sail means, releasably attached to said sail mares and to said mast means, said boom means being manually engageable;

a plurality of rudders, comprising a fore rudder and an aft rudder, rotatably mounted under said hulls, for providing steering ability to said vessel said fore rudder being detachably mounted;

a steering assembly engageably mounted on said hulls and pivotally connected to said plurality of rudders, comprising a tiller linkage rod and steering centering means releasably resiliently connecting said tiller linkage rod to a stationary part of said vessel for returning said steering assembly to a centered position, thereby causing said plurality of rudders to return to an amidships position;

a plurality of foot-operable tiller paddles, mounted on said tiller linkage rod, for transmitting directional control to said rudder means, thereby allowing the sailor to direct the course of said vessel.

2. A wind powered sailing catamaran, operable by a standing sailor, comprising:

two upwardly curved, elongated hulls substantially triangular in transverse cross-section, each said hull thereby forming a keel;

platform means for providing deck space, whereby said hulls are joined and held substantially parallel to each other;

mast mount means, comprising a fore and aft slidably adjustable mast track assembly attached to said catamaran, for carrying a mast;

mast means for carrying sail means and boom means, said mast means being pivotally mounted onto said mast track assembly, thereby being fully articulating and fore and aft translocatable on said catamaran;

sail means, releasably attached to said mast means, for providing wind power; boom means for directionally controlling said sail means, releasably attached to said sail means and to said mast means, said boom means being manually engageable;

a plurality of rudders, comprising a fore rudder and an aft rudder, rotatably mounted under said hulls, for providing steering ability to said catamaran, said fore rudder being detachably mounted;

a steering assembly engageably mounted on said hulls and pivotally connected to said plurality of rudders, comprising a tiller linkage rod and steering centering means releasably resiliently connecting said tiller linkage rod to a stationary part of said catamaran, for returning said steering assembly to a centered position, thereby causing said plurality of rudders to return to an amidships position;

a plurality of foot-operable tiller paddles, mounted on said tiller linkage rod, for transmitting directional control to said rudder means, thereby allowing the sailor to direct the course of said catamaran.

* * * * *